US008721015B2

(12) United States Patent
Shinkai

(10) Patent No.: US 8,721,015 B2
(45) Date of Patent: May 13, 2014

(54) FUNCTIONAL LIQUID TANK, METHOD FOR REPLENISHING FUNCTIONAL LIQUID IN DROPLET DICHARGE DEVICE, AND DROPLET DISCHARGE DEVICE

(71) Applicant: Seiko Epson Corporation, Tokyo (JP)

(72) Inventor: Katsumi Shinkai, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 13/746,827

(22) Filed: Jan. 22, 2013

(65) Prior Publication Data

US 2013/0127938 A1 May 23, 2013

Related U.S. Application Data

(63) Continuation of application No. 12/716,943, filed on Mar. 3, 2010, now Pat. No. 8,382,222.

(30) Foreign Application Priority Data

Mar. 19, 2009 (JP) ..... 2009-068339

(51) Int. Cl.
*B41J 29/38* (2006.01)
*B41J 2/195* (2006.01)
*B41J 29/393* (2006.01)

(52) U.S. Cl.
USPC ..... 347/7; 347/6; 347/14; 347/19

(58) Field of Classification Search
USPC ..... 347/6–7, 14, 19
See application file for complete search history.

(56) References Cited

U.S. PATENT DOCUMENTS

| | | | | |
|---|---|---|---|---|
| 7,033,005 | B2 | 4/2006 | Nakamura | |
| 2003/0030682 | A1* | 2/2003 | Kim et al. | 347/7 |
| 2008/0238957 | A1* | 10/2008 | Hayashi | 347/7 |
| 2008/0273063 | A1* | 11/2008 | Wouters et al. | 347/85 |
| 2009/0262153 | A1 | 10/2009 | Tamaki et al. | |

FOREIGN PATENT DOCUMENTS

JP 2004-188410 A 7/2004

* cited by examiner

*Primary Examiner* — Jason Uhlenhake
(74) *Attorney, Agent, or Firm* — Global IP Counselors, LLP

(57) ABSTRACT

A droplet discharge device includes a functional liquid droplet discharge head and a functional liquid tank. The functional liquid tank includes a tank body, a liquid column pipe and a liquid level detection mechanism. The tank body is configured and arranged to retain the functional liquid to be supplied to the functional liquid droplet discharge head. The liquid column pipe communicates with the tank body. The liquid level detection mechanism is configured and arranged to detect a liquid level of the functional liquid retained in the liquid column pipe. The functional liquid tank is configured and arranged to allow supplying and ventilating of gas.

6 Claims, 10 Drawing Sheets

FUNCTIONAL LIQUID TANK, METHOD FOR REPLENISHING FUNCTIONAL LIQUID IN DROPLET DICHARGE DEVICE, AND DROPLET DISCHARGE DEVICE

CROSS-REFERENCE TO RELATED APPLICATIONS

This is a continuation application of U.S. patent application Ser. No. 12/716,943 filed on Mar. 3, 2010. This application claims priority to Japanese Patent Application No. 2009-068339 filed on Mar. 19, 2009. The entire disclosures of U.S. patent application Ser. No. 12/716,943 and Japanese Patent Application No. 2009-068339 are hereby incorporated herein by reference.

BACKGROUND

1. Technical Field

The present invention relates to a functional liquid tank for receiving the supply of functional liquid from a functional liquid supply source and supplying the functional liquid to an inkjet functional liquid droplet discharge head. The present invention also relates to a method for replenishing functional liquid in a droplet discharge device and to a droplet discharge device.

2. Related Art

In conventional practice, there has been known a method for filling a droplet discharge head with functional liquid. According to this method, the functional liquid is not replenished in a droplet discharge device, but the flow channels in the head of a droplet discharge head are filled with functional liquid by feeding and suctioning (see Japanese Laid-Open Patent Application No. 2004-188410). This functional liquid filling method is implemented primarily when the droplet discharge head is replaced, and the method comprises a pressurizing liquid feed step in which compressed air is supplied to an airtight liquid supply sub-tank, the functional liquid in the liquid supply sub-tank is fed to the droplet discharge head, and the functional liquid fills the flow channels in the head of the droplet discharge head; and a suction step following the pressurizing liquid feed step, in which a suction unit is driven and functional liquid is suctioned from the nozzles of the droplet discharge head. Thus, the droplet discharge head is subjected to a filling action for feeding the functional liquid and a subsequent functional liquid suctioning action, thereby making an initial filling possible and preventing air bubbles from remaining in the flow channels in the head.

SUMMARY

When different functional liquids are introduced into a functional liquid supply device for supplying functional liquid to a functional liquid droplet discharge head, if the conventional method for filling functional liquid described above is emulated, the old functional liquid introduced into the filled flow channel (entire flow channel) of the functional liquid supply device will be entirely removed at this time, after which fresh functional liquid is introduced using the filling action and suction action described above. However, it is known from experience that once all of the functional liquid in all of the flow channels has been removed, the discharge characteristics of the filled functional liquid droplet discharge head deteriorate. According to one method considered for replenishing functional liquid, the functional liquid is gradually replenished in the flow channels by repeatedly suctioning old functional liquid without emptying the sub-tank while fresh functional liquid is simultaneously introduced.

Since the sub-tank described above is provided with an upper limit detection sensor for detecting the upper limit of the functional liquid level and a lower limit detection sensor for detecting the lower limit of the functional liquid level, another option that can be considered is to use these sensors and replenish functional liquid by alternately repeating a removal step for removing liquid until the surface of old functional liquid retained in the sub-tank is sensed by the lower limit detection sensor, and a liquid feeding step for feeding fresh functional liquid into the sub-tank. However, in this case, a large amount of old functional liquid remains below the lower limit detection sensor, and a large amount of functional liquid is therefore consumed until the sub-tank is completely replenished with fresh functional liquid.

In such cases, a method has been considered for ending the removal step after timer control is performed and a specified amount of time elapses following the detection of the liquid level by the lower limit detection sensor. However, when there is only a certain small amount of functional liquid remaining below the lower limit detection sensor and the viscosities of the functional liquids differ, the rate at which the liquid level descends varies due to different amounts of pressure lost, and problems occur in that the liquid cannot be sufficiently removed, excessive liquid is removed and the gas in the sub-tank flows out to the functional liquid droplet discharge head, and the like.

An object of the present invention is to provide a functional liquid tank, a method for replenishing functional liquid in a droplet discharge device, and a droplet discharge device wherein old functional liquid can be replaced with fresh functional liquid appropriately and efficiently.

According to one aspect, a droplet discharge device includes a functional liquid droplet discharge head and a functional liquid tank. The functional liquid droplet discharge head is configured and arranged to discharge functional liquid. The functional liquid tank includes a tank body, a liquid column pipe and a liquid level detection mechanism. The tank body is configured and arranged to retain the functional liquid to be supplied to the functional liquid droplet discharge head. The liquid column pipe communicates with the tank body. The liquid level detection mechanism is configured and arranged to detect a liquid level of the functional liquid retained in the liquid column pipe. The functional liquid tank is configured and arranged to allow supplying and ventilating of gas.

BRIEF DESCRIPTION OF THE DRAWINGS

Referring now to the attached drawings which form a part of this original disclosure.

DETAILED DESCRIPTION OF EXEMPLARY EMBODIMENTS

The following is a description, made with reference to the accompanying drawings, of a droplet discharge device which applies the method for replenishing functional liquid according to an embodiment of the present invention. This droplet discharge device is incorporated in a flat panel display manufacturing line. The device uses a functional liquid droplet discharge head that brings in special ink or a functional liquid that is, e.g., a luminescent resin liquid, and the device forms the color filter of a liquid crystal display device, the light-emitting elements that serve as pixels of an organic EL device, or the like.

Figure 1:
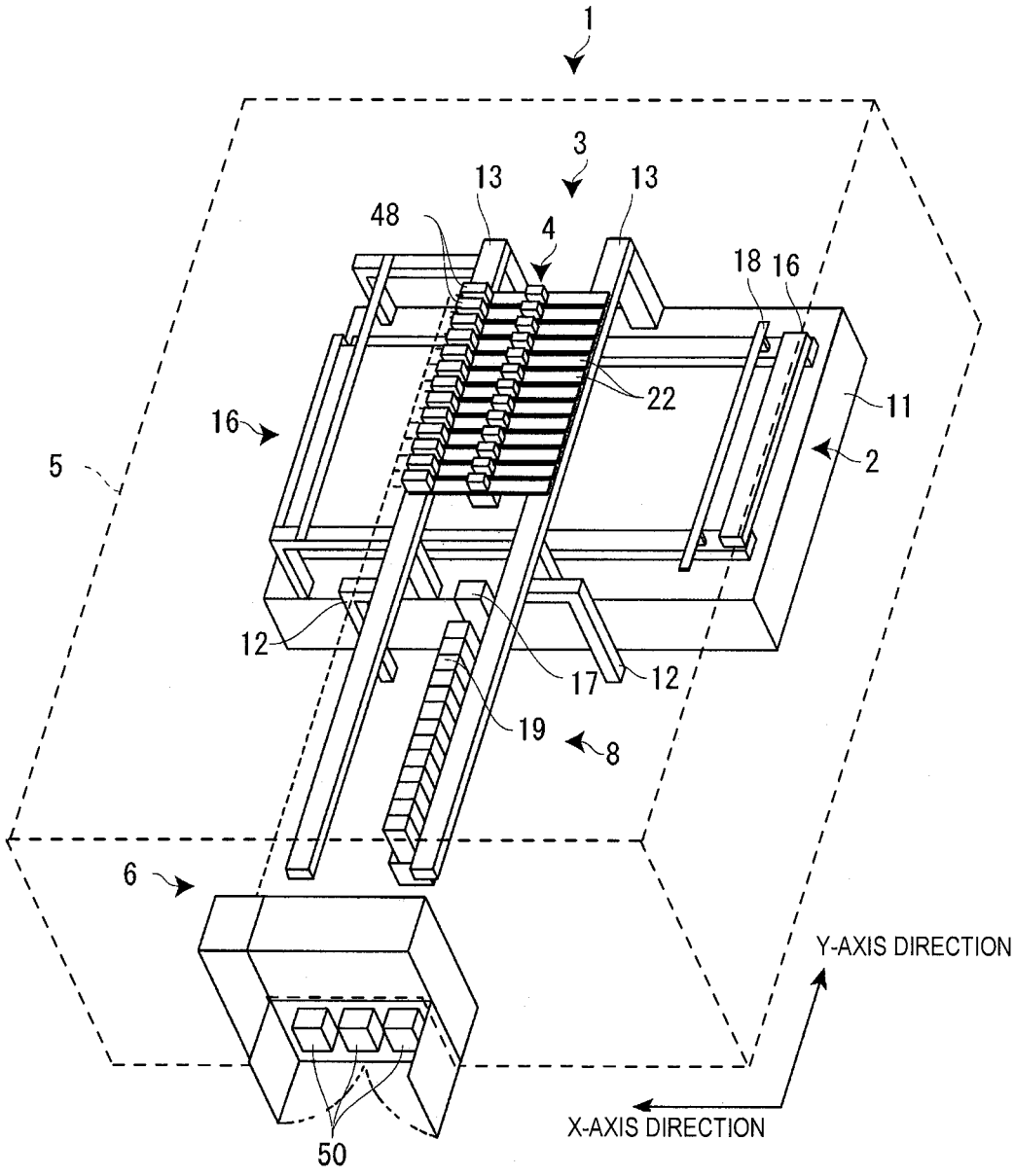
FIG. 1 is a perspective view of a droplet discharge device.

A droplet discharge device 1 is composed of an X-axis table 2 provided on an X-axis support base 11 supported on a stone surface plate, wherein the X-axis table extends in an X-axis direction which is a main scanning direction and moves a workpiece in the X-axis direction; a Y-axis table 3 provided on a pair of Y-axis support bases 13 spanning across the X-axis table 2 via a plurality of support braces 12, wherein the Y-axis table extends in a Y-axis direction which is a sub-scanning direction; and thirteen carriage units 4 on which a plurality of functional liquid droplet discharge heads 14 (not shown in FIG. 1) are mounted; wherein the thirteen carriage units 4 are suspended from the Y-axis table 3, as shown in FIG. 1. Furthermore, the droplet discharge device 1 comprises a chamber 5 for housing these devices in an atmosphere whose temperature and humidity are managed, and a functional liquid supply unit 6 having three functional liquid supply devices 15 (see FIG. 4) which pass through the chamber 5 and supply functional liquid from the exterior of the chamber 5 to the functional liquid droplet discharge heads 14 therein. The functional liquid droplet discharge heads 14 are dischargeably driven in synchronization with the driving of the X-axis table 2 and the Y-axis table 3, whereby functional liquid droplets in three colors (red, green, and blue) supplied form the functional liquid supply unit 6 are discharged and a predetermined drawn pattern is drawn on the workpiece.

The droplet discharge device 1 also comprises a maintenance device 8 composed of a flushing unit 16, a wiping unit 17, a discharge performance inspection unit 18, and a suction unit 19 described hereinafter. These units are provided for the maintenance of the functional liquid droplet discharge heads 14, allowing for the function preservation and function restoration of the functional liquid droplet discharge heads 14.

Figure 2:
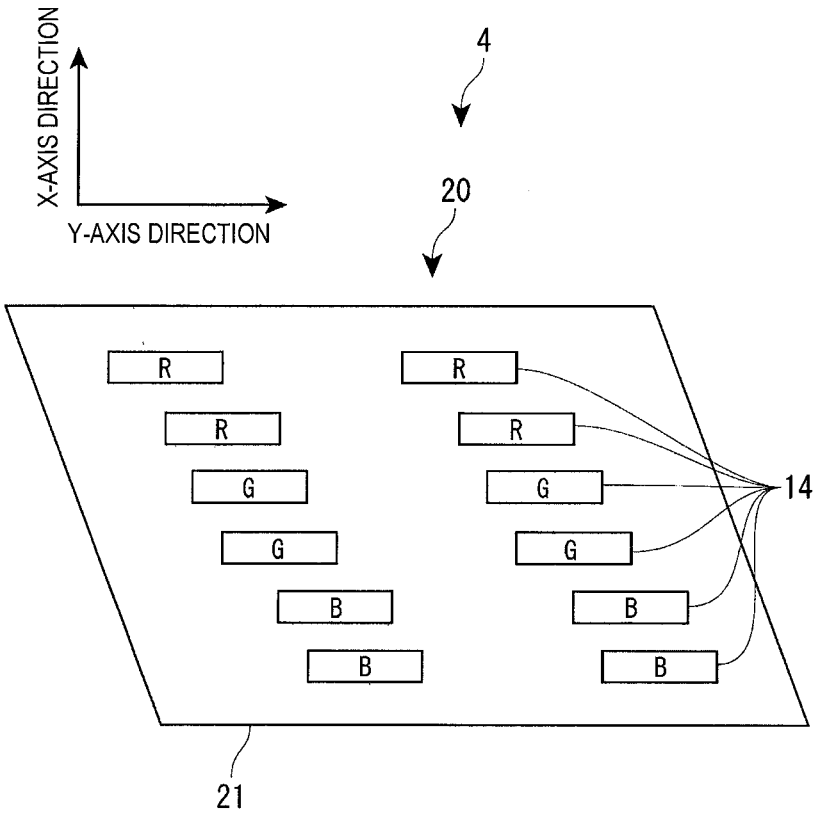
FIG. 2 is a schematic plan view of a head unit.

The carriage units 4 each comprise a head unit 20 composed of twelve functional liquid droplet discharge heads 14 and a carriage plate 21 for supporting the twelve functional liquid droplet discharge heads 14 divided into two groups of six, as shown in FIG. 2. The carriage units 4 are suspended from bridge plates 22 extending across the tops of the pair of Y-axis support bases 13. The carriage units 4 are designed so that natural water heads are used from sub-tanks (functional liquid tanks) 48 provided on the bridge plates 22, and functional liquid is supplied to the functional liquid droplet discharge heads 14 via pressure regulation valves 23 (see FIG. 4). The number of carriage units 4 and the number of functional liquid droplet discharge heads 14 mounted on each carriage unit 4 are arbitrary.

Figure 3:
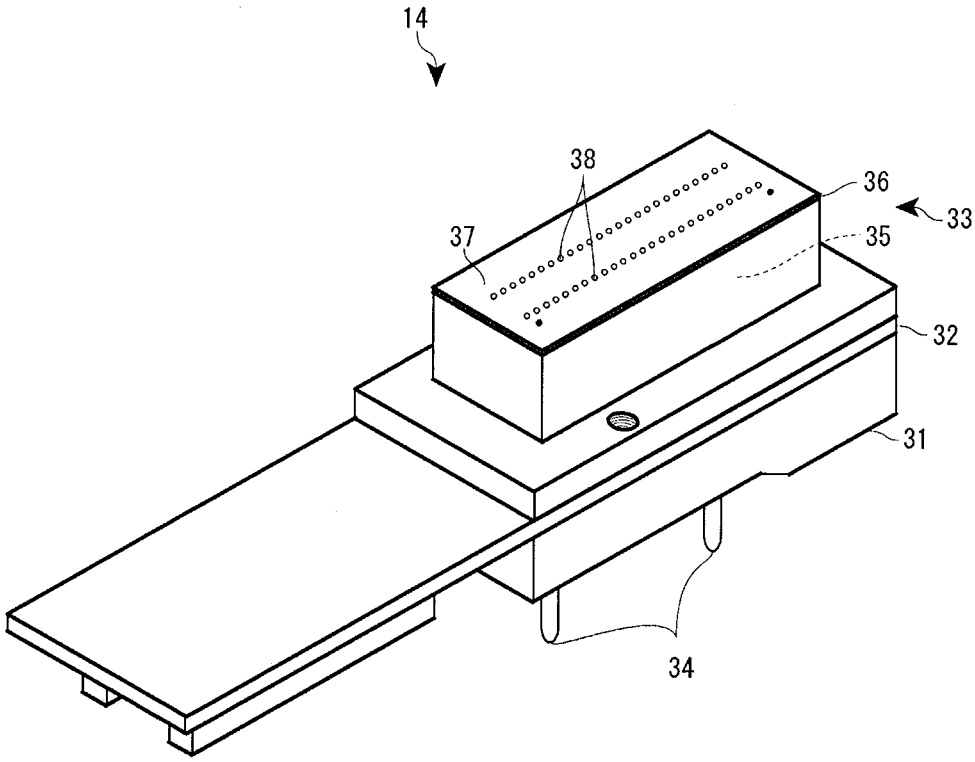
FIG. 3 is an external perspective view of a functional liquid droplet discharge head.

Each of the functional liquid droplet discharge heads 14 is a so-called double inkjet head, comprising a functional liquid feeder 31 having two connecting pins 34, two head substrates 32 joined to the side of the functional liquid feeder 31, and a head main body 33 joined to the bottom of the head substrates 32 and filled with functional liquid therein, as shown in FIG. 3. The connecting pins 34 are connected to the functional liquid supply unit 6, and functional liquid is supplied to the functional liquid feeder 31. The head main body 33 is configured from a cavity (piezoelectric element) 35, and a nozzle plate 36 having a nozzle surface 37 in which numerous discharge nozzles 38 are formed. When the functional liquid droplet discharge head 14 is dischargeably driven, functional liquid droplets are discharged from the discharge nozzles 38 by the pumping action of the cavity 35.

Figure 4:
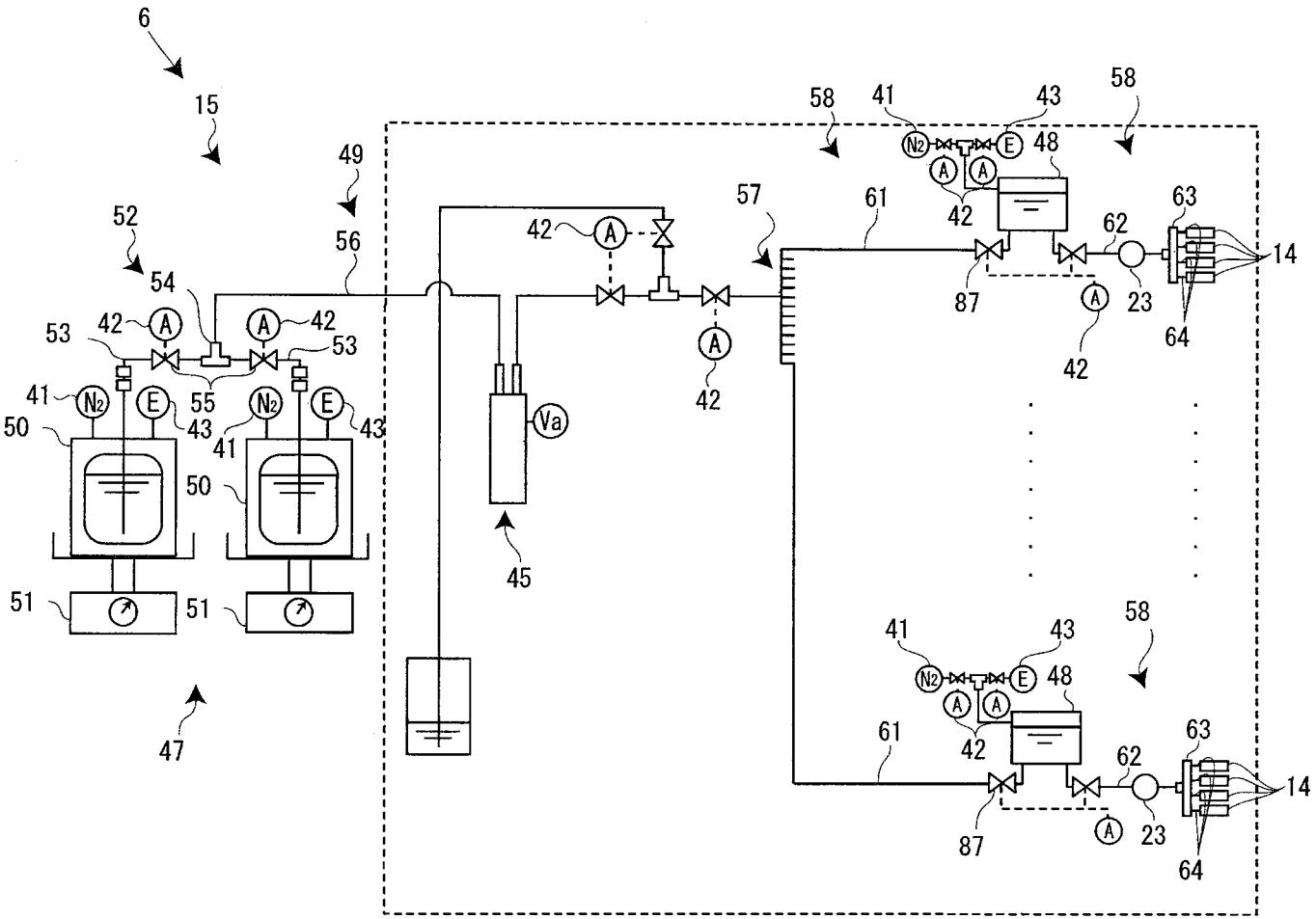
FIG. 4 is a piping system diagram of a functional liquid supply device.

The functional liquid supply unit 6 comprises three functional liquid supply devices 15 corresponding to the three colors red, green, and blue, as shown in FIG. 4. The functional liquid supply unit 6 comprises nitrogen gas supply facilities 41 for supplying compressed nitrogen gas for controlling main tanks (functional liquid supply sources) 50, sub-tanks 48, and the like; compressed air supply facilities 42 for supplying compressed air for controlling various opening and closing valves; gas ventilation facilities 43 for ventilating gas from these components; and an air bubble expulsion unit 45. The three functional liquid supply devices 15 are connected to functional liquid droplet discharge heads 14 corresponding to the three colors red, green, and blue, whereby functional liquid of the corresponding color is supplied to the functional liquid droplet discharge heads 14 of each color.

Each of the functional liquid supply devices 15 comprises a tank unit 47 having two main tanks 50, 50 constituting a functional liquid supply source, thirteen sub-tanks 48 provided in correspondence with the carriage units 4, and functional liquid flow channels 49 for connecting the tank unit 47 and the functional liquid droplet discharge heads 14. The functional liquid in the main tanks 50 is pressurized by the compressed nitrogen gas from the nitrogen gas supply facilities 41 connected thereto, and is selectively supplied to the thirteen sub-tanks 48 via the functional liquid flow channels 49. At this time, the various opening and closing valves are controlled to open and close by the compressed air from the compressed air supply facilities 42. At the same time, the sub-tanks 48 are opened to the atmosphere via the gas ventilation facilities 43, and the necessary amount of functional liquid is received. The functional liquid of the sub-tanks 48 is supplied to the functional liquid droplet discharge heads 14 via the functional liquid flow channels 49 by the driving of the connected functional liquid droplet discharge heads 14 while a predetermined water head pressure is maintained. Instead of feeding the liquid by gas pressure as described above, the liquid may be fed by pumping.

The tank unit 47 comprises a pair of main tanks 50, 50 as functional liquid supply sources, a pair of weight measurement devices 51, 51 for respectively measuring the weight of the pair of main tanks 50, 50, and a switching mechanism (flow channel switching unit) 52 for switching the communication to the functional liquid flow channels 49 from one main tank 50 to the other main tank 50. Connected to each of the main tanks 50 is a nitrogen gas supply facility 41 and a gas ventilation facility 43 for performing positive pressure control for pressure-feeding the functional liquid and negative pressure control (equivalent to opening to the atmosphere) for returning the functional liquid.

The switching mechanism 52 comprises a pair of tank flow channels 53, 53 connected to the pair of main tanks 50, 50, a tank flow channel coupler 54 connected at the upstream side to the pair of tank flow channels 53, 53 and connected at the downstream side to the functional liquid flow channels 49, and tank opening/closing valves 55 provided in the paths of the tank flow channels 53, 53. Closing one tank opening/closing valve 55 and opening the other tank opening/closing valve 55 causes the connection to the functional liquid flow channels 49 to switch alternately between the pair of main tanks 50, 50.

Each of the functional liquid flow channels 49 is configured from a main functional liquid flow channels 56 connected at the upstream end to one tank unit 47; thirteen branching flow channels 57 for dividing the main functional liquid flow channel 56 into thirteen branches, the branching flow channels being connected to the downstream end of the main functional liquid flow channel 56; and individual functional liquid flow channels 58 for connecting the thirteen branching flow channels 57 and the functional liquid droplet discharge heads 14. Provided in the path of the main functional liquid flow channel 56 is the air bubble expulsion unit 45 for expelling microbubbles in the functional liquid over time via a gas-permeable membrane.

Each of the individual functional liquid flow channels 58 is configured from a tank-side flow channel 61 connected at the upstream end to one branching flow channel 57, a head-side flow channel 62 connected at the upstream side to one sub-tank 48, four branching flow channels 63 connected at the upstream sides to the head-side flow channel 62, and a plurality of individual flow channels 64 connected at the upstream sides to the four branching flow channels 63. The functional liquid is thereby branched four ways from each sub-tank 48 and is connected to the respective functional liquid droplet discharge heads 14. In other words, functional liquid is supplied to the 13×4 functional liquid droplet discharge heads 14 by the thirteen branches of each of the functional liquid flow channels 49 and the four branches of each of the individual functional liquid flow channels 58.

Figure 5:
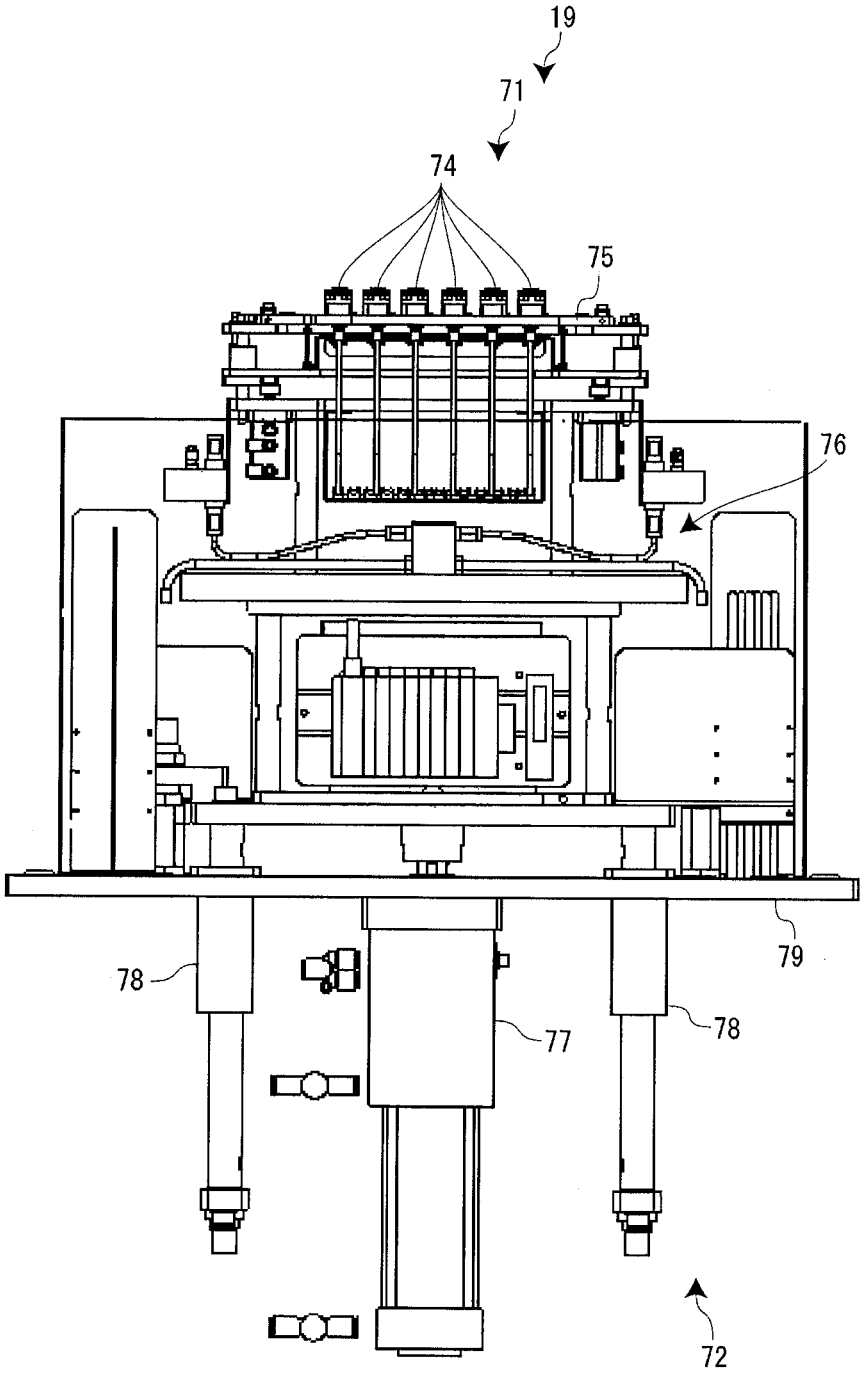
FIG. 5 is a side view of a suction unit.

The suction unit 19 comprises thirteen cap units 71 in which twelve head caps 74 corresponding to the twelve functional liquid droplet discharge heads 14 are disposed on a cap plate 75, thirteen raising/lowering mechanisms 72 for raising and lowering the cap units 71 via the support plate 76, thirteen suction flow channel systems joined to the cap units 71 and having functional liquid suction flow channels, and suction mechanisms (none of which are shown) joined to the suction flow channel systems and each having two disposed liquid tanks corresponding to two pressure levels, as shown in FIG. 5. Though not shown in the drawings, the suction unit 19 also comprises compressed a air supply facility for supplying compressed air for control to the pressure control mechanisms and other components, an air ventilation facility for venting air from the components, and a functional liquid disposal facility for disposing of retained functional liquid.

The cap units 71 are configured from the head caps 74 corresponding to a total of twelve functional liquid droplet discharge heads 14, two for each color, and the cap plate 75 on which the cap units are mounted. Each of the raising/lowering mechanisms 72 has a raising/lowering cylinder 77 for directly raising and lowering the head caps 74 via the support plate 76, a pair of linear guides 78 for guiding the raising and lowering by the raising/lowering cylinders 77, and a base part 79 for supporting these components.

The suction action of the suction unit 19 is performed by raising the cap units 71 using the raising/lowering mechanisms 72, bringing in the head caps 74 corresponding to the functional liquid droplet discharge heads 14, and then suctioning the functional liquid from the discharge nozzles 38 of the functional liquid droplet discharge heads 14 by driving an ejector (not shown).

Figure 6:
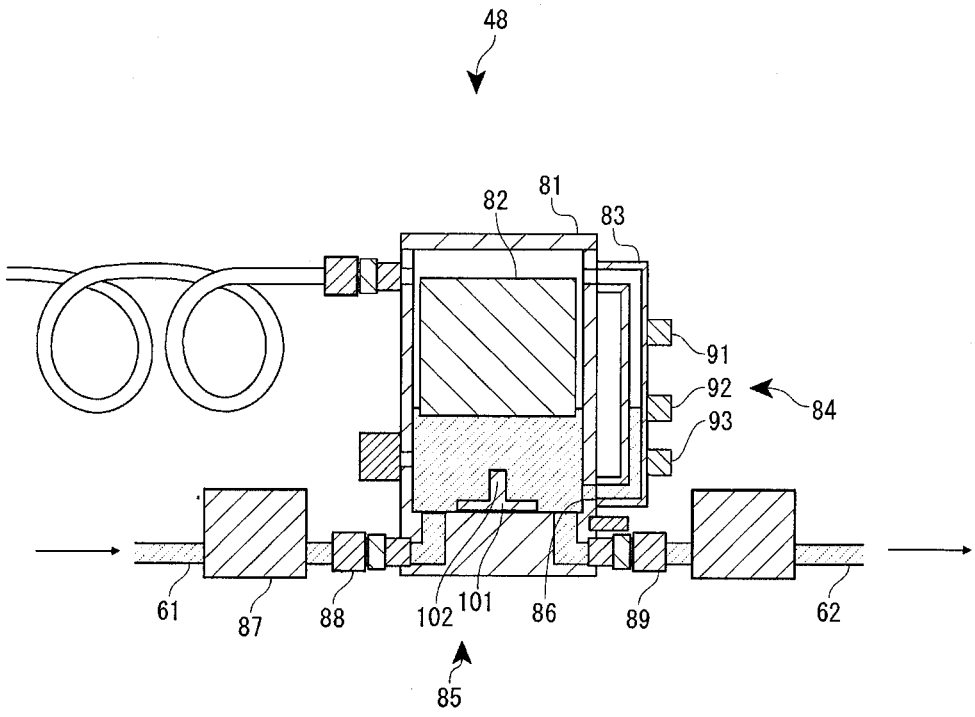
FIG. 6 is a cross-sectional view schematically depicting the surroundings of a sub-tank according to the first embodiment.

A sub-tank (functional liquid tank) 48 according to the present embodiment is described in detail with reference to FIG. 6. The sub-tank 48 comprises a sub-tank body (tank body) 81 for retaining functional liquid, a lid float (float member) 82 that floats on the sub-tank body 81 in the manner of a lid, a transparent liquid column pipe 83 appended to the sub-tank body 81, a liquid level detection mechanism 84 that faces the liquid column pipe 83 and detects the level of retained functional liquid, and an immersed member (float-regulating member) 85, which is provided at the bottom of the sub-tank body 81 and which regulates the descending end position of the lid float 82 at the upper side of a bottom connecting hole 86 of the liquid column pipe 83. At the bottom of the sub-tank 48 are provided an inlet port 88 connected to a tank-side flow channel 61 via a sub-tank opening/closing valve 87, and an outlet port 89 connected to a head-side flow channel 62. Thus, the configuration is designed so that the functional liquid flows in from below the sub-tank body 81 and also flows out from below. A nitrogen gas supply facility 41 and a gas ventilation facility 43 are also connected to the top of the sub-tank body 81 (see FIG. 4), and the interior of the sub-tank body 81 is configured so as to be capable of opening to the atmosphere when liquid is fed from the main tank 50, and so that the pressure increase to the main tank 50 can be controlled.

The liquid level detection mechanism 84 comprises an upper limit detection sensor (upper limit liquid level detection unit) 91 that faces the liquid column pipe 83 and detects the upper limit of the functional liquid level, a liquid level detection sensor 92 that is provided in a vertically intermediate position and that detects the functional liquid level during refilling, and a lower limit detection sensor (lower limit liquid level detection unit) 93 for detecting the lower limit of the functional liquid level. The upper limit detection sensor 91 is provided in order to prevent overflowing in the sub-tank 48, and when the upper limit detection sensor 91 has detected an upper limit liquid level, the liquid feed from the main tank 50 is stopped. The lower limit detection sensor 93 is provided in order to prevent the sub-tank 48 from becoming empty, and when the lower limit detection sensor 93 has detected a lower limit liquid level, the droplet discharge device 1 is stopped when the drawing currently being performed on the workpiece ends. The lower limit detection sensor 93 is also used when functional liquid is removed in the method for replenishing functional liquid described hereinafter. When liquid is removed, timer control is performed using the liquid level detection by the lower limit detection sensor 93 as a trigger.

The liquid level detection sensor 92 detects a liquid level which accounts for the ideal water head value of the functional liquid droplet discharge heads 14, and when the functional liquid level is detected by the liquid level detection sensor 92, a determination is made through coordination with the control device as to whether the liquid level has risen or fallen. Specifically, the liquid level is determined to have fallen when the functional liquid has been reduced by the discharge action from a state in which the liquid level is higher than the liquid level detection sensor 92, and the liquid level being detected by the liquid level detection sensor 92. The liquid level is determined to have risen when the functional liquid is increased by the refilling action from a state in which the liquid level is lower than the liquid level detection sensor 92, the liquid level is detected by the liquid level detection sensor 92, and a specified time has elapsed thereafter. The functional liquid level in the sub-tank 48 is controlled at a vertically intermediate position by this type of liquid level detection sensor 92.

The following is a description of the action of refilling functional liquid from the main tank 50 used as a functional liquid supply source to the sub-tank 48. When the functional liquid in the sub-tank 48 decreases by a specified amount and the liquid level detection mechanism 84 described above determines that the liquid level has decreased, the sub-tank opening/closing valve 87 is opened and functional liquid is refilled from the main tank 50 to the sub-tank 48. Since the pressure in the main tank 50 has been increased, opening the sub-tank opening/closing valve 87 and opening the sub-tank 48 interior to the atmosphere causes the functional liquid in the main tank 50 to be automatically fed to the sub-tank 48. When a specified amount of functional liquid has accumulated in the sub-tank 48 and the liquid level detection mechanism 84 has determined that the liquid in the sub-tank 48 is full, the sub-tank opening/closing valve 87 is closed and the refilling action is ended.

The lid float 82 is formed from a chemically resistant metal material into a thin rectangular solid shape having a hollow interior. More specifically, the lid float comprises stainless steel sheets machined into a box shape, and is formed into a shape substantially similar to the top surface of the sub-tank body 81 when viewed from above so that there is a small gap in between the two. The immersed member 85 is positioned directly below the lid float 82 and is immersed so as to rest on the bottom surface of the sub-tank body 81.

The immersed member 85 functions only in the case of a temporary extreme reduction in the amount of functional liquid remaining in the sub-tank 48 in the method for replenishing functional liquid described hereinafter. The immersed member is configured from a plate-shaped immersed plate 101 and an immersed protrusion 102 standing upright in the middle of the immersed plate 101. The immersed member 85 is formed so that when it is immersed, the top end thereof is in a higher position than the bottom connecting hole 86 of the liquid column pipe 83. More specifically, the immersed member is arranged so as to be capable of regulating the descending end position of the lid float 82 so that the bottom surface of the lid float 82 is in a position lower than the lower limit detection sensor 93 and higher than the bottom connecting hole 86. The immersed member 85 is preferably formed so as to have a height reaching from the bottom surface of the sub-tank body 81 to the top end of the bottom connecting hole 86 of the liquid column pipe 83. It shall be apparent that the immersed member 85 is configured from a chemically resistant (resistant to the functional liquid) metal having a sufficiently greater relative density than the functional liquid, and the shape thereof is arbitrary. For example, the immersed member may be configured in the form of a mesh in order to have a smaller volume (e.g., a perforated metal), and the mesh may be bent or curved so as to have a predetermined height and may be immersed in the functional liquid.

The sub-tank body 81, which is underneath the bottom surface of the lid float 82 whose position is regulated by the immersed member 85, is designed to have a capacity that will not affect the timer control when the functional liquid is being removed. The details are described hereinafter, but in the method for replenishing functional liquid of the present embodiment, liquid is removed so that the liquid level falls to the vicinity of the outlet port 89, and timer control is performed with precision so that the amount of a single liquid removal increases and gas does not flow in toward the functional liquid droplet discharge heads 14. Liquids of different viscosities are used for the replenished functional liquid; i.e., the functional liquid used, and even with functional liquids of different viscosities, the object of the timer control as well as the amount of functional liquid are defined to a certain extent so that the timer can be stably controlled.

Since the suction unit 19 described above is configured so as to suction functional liquid with a specified pressure, in cases in which the suction unit has a capacity for a small amount of functional liquid when functional liquid is being removed, the rate at which the liquid level falls in the sub-tank 48 increases, and timer control accounting for a functional liquid of a different viscosity becomes unstable. Therefore, the descending end position of the lid float 82 is regulated and the object of timer control as well as the functional liquid amount are defined to a certain extent, so that functional liquid of a different viscosity can be appropriately removed under timer control for a specified amount of time.

Figure 7:
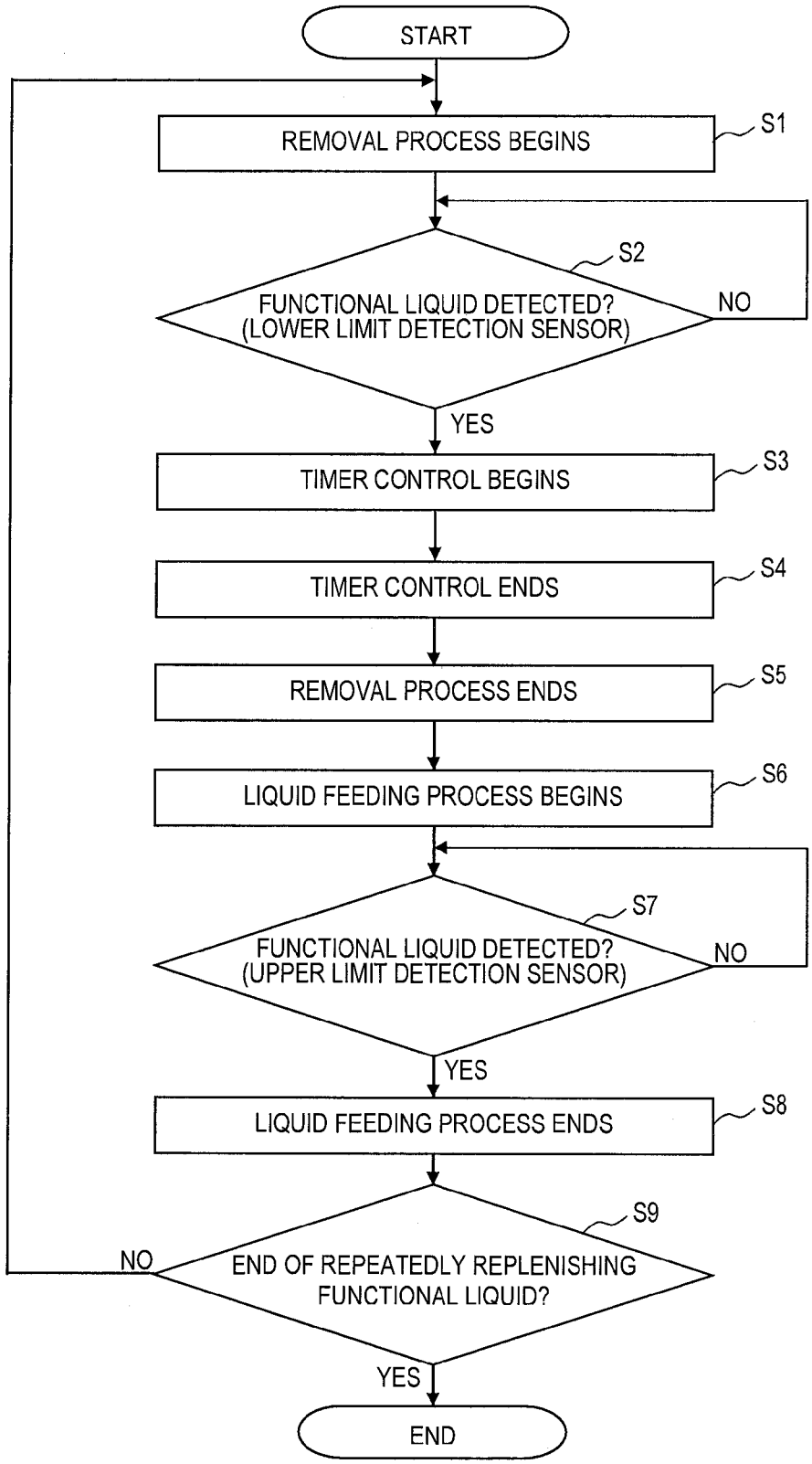
FIG. 7 is a flowchart of the method for replenishing functional liquid.

The following is a description, made with reference to FIG. 7, of a method for replenishing functional liquid in the functional liquid supply devices 15 (the functional liquid supply unit 6). This method for replenishing functional liquid involves removing (incompletely) functional liquid (old functional liquid) filled in the functional liquid supply devices 15 (in all the flow channels) and introducing functional liquid (fresh functional liquid) having a different constitution, wherein the process of removing and filling is repeated. It shall be apparent that the functional liquid replenishing sequence starts from a state in which old functional liquid remains in one main tank 50 and the other main tank 50 filled with fresh functional liquid has been set. After the functional liquid is suctioned from the discharge nozzles 38 of the functional liquid droplet discharge heads 14 by the suction unit 19 and the lower limit detection sensor 93 has detected the liquid level, a partial replenishing step is repeated a predetermined number of times, the partial replenishing step comprising a removal process for removing a predetermined amount of functional liquid from the sub-tanks 48 by timer control for a predetermined amount of time, and a liquid feeding step for pressure-feeding functional liquid from the main tanks 50 to the sub-tanks 48.

First, the flow channels are switched by the switching mechanism 52 from the main tank 50 containing old functional liquid currently being used to the main tank 50 filled with fresh functional liquid. Next, the suction unit 19 is driven and the removal process (S1 to S5) in which liquid is removed from the sub-tanks 48 is started. Reverse-feed pipes connected to the disposal tanks are provided in the functional liquid flow channels 49 extending from the main tanks 50 to the sub-tanks 48, whereby fresh functional liquid may be fed from the main tanks 50 so as to push out the old functional liquid in the flow channels, and the old functional liquid may be fed to the disposal tanks through the reverse-feed pipes.

Liquid starts to flow out of the sub-tanks 48, and when the falling liquid level reaches the position of the lower limit detection sensors 93 and the lower limit detection sensors 93 detect the level of the functional liquid ("Yes" in S2), the liquid removal is switched to timer control (S3). Under timer control, the timer duration is set so that as much functional liquid as possible is removed from the sub-tanks 48 as calculated in advance from the remaining amount of functional liquid and the viscosity of the functional liquid. The liquid column pipes 83 are thereby depleted of functional liquid, and substantially no functional liquid remains in the sub-tanks 48. More specifically, a sufficient amount of liquid is removed so that the outlet ports 89 are not exposed above the liquid surfaces.

The sub-tank opening/closing valves 87 are then opened and liquid feeding process for feeding liquid to the sub-tanks 48 (steps S6 to S9) is started. Specifically, the sub-tank opening/closing valves 87 are left open and the first sub-tank 48 is filled with functional liquid until the upper limit detection sensor 91 of the first sub-tank 48 detects a full liquid level ("Yes" in S7). In this case, the replenishing rate is markedly improved because old functional liquid remains in portions (small gaps) where it does not readily mix with fresh functional liquid, such as the space between the sub-tank 48 and the lid float 82 and the interior of the liquid column pipe 83. A high replenishing rate is maintained particularly in cases in which the relative density of the fresh functional liquid is greater than that of the old functional liquid. The first partial replenishing process (S1 to S9) of the first sub-tank 48 thereby concludes. The partial replenishing process is then performed on the second through thirteenth sub-tanks 48, thereby concluding the first series of partial replenishing process. After the first series of partial replenishing process has ended, a second series of partial replenishing process is performed on the first through thirteenth sub-tanks 48. The partial replenishing process is then repeated multiple times (a predetermined number of times), thereby concluding functional liquid replenishing in all of the flow channels extending from the main tanks 50 to the functional liquid droplet discharge heads 14. The number of repetitions is a number that enables the functional liquid suctioned from the functional liquid droplet discharge heads 14 to have a replenishing rate (99.0%) nearly equivalent to complete replenishing, and the number of repetitions is preferably a number determined experimentally in advance so as to achieve the aforementioned replenishing rate.

Figure 8:
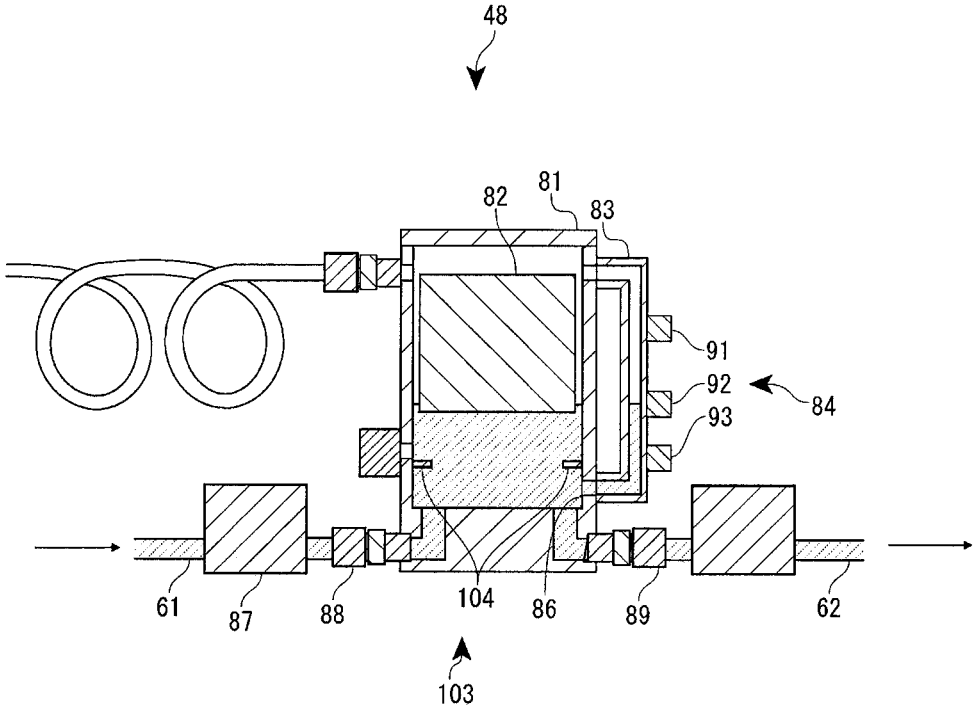
FIG. 8 is a cross-sectional view schematically depicting the surroundings of a sub-tank according to the second embodiment.

The following is a description, made with reference to FIG. 8, of a sub-tank 48 according to the second embodiment of the present invention. The description primarily focuses on different components in order to avoid superfluous description. In this sub-tank 48, an extended protrusion 103, made of stainless steel or a plastic material, is provided on the bottom inside surface of the sub-tank body 81 as a float-regulating member. The extended protrusion 103 is configured from four individual protrusions 104 provided at the same height on the four inside walls of the sub-tank body 81, and is disposed so as to be positioned above the bottom connecting hole 86 of the liquid column pipe 83. More specifically, the extended protrusion 103 is disposed so as to be capable of regulating the descending end position of the bottom surface of the lid float 82 at a position lower than the lower limit detection sensor 93 and higher than the bottom connecting hole 86. Furthermore, the extended protrusion 103 is preferably disposed at the same height as the top end of the bottom connecting hole 86 of the liquid column pipe 83. In this case as well, the capacity of the sub-tank body 81, which is underneath the bottom surface of the lid float 82 whose position is regulated by the extended protrusion 103, is designed so as not to affect the timer control when the functional liquid is being removed.

Figure 9:
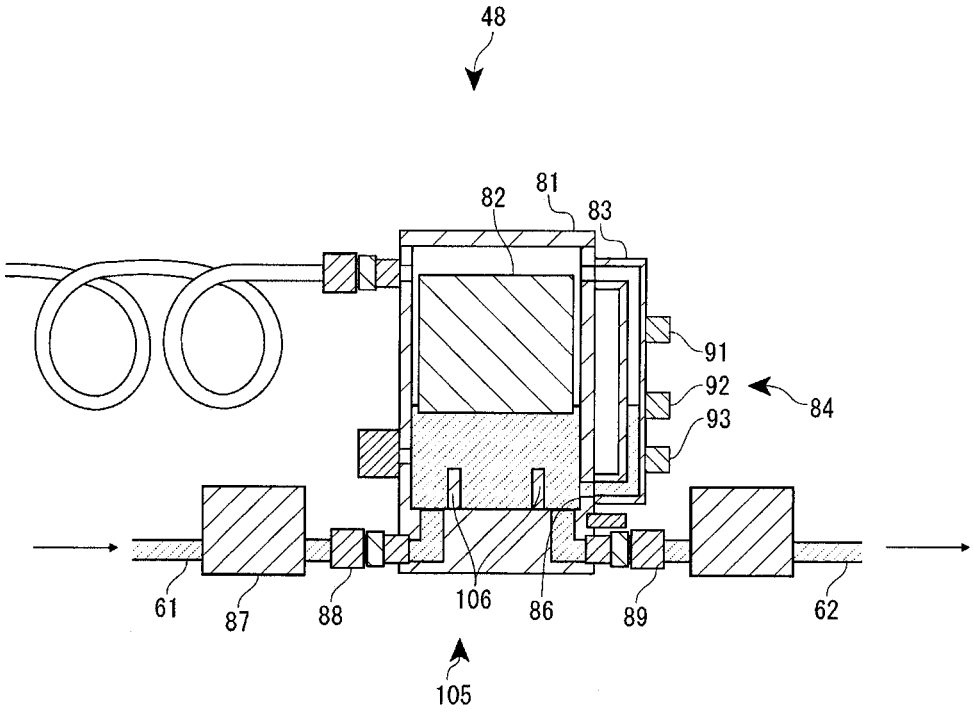
FIG. 9 is a cross-sectional view schematically depicting the surroundings of a sub-tank according to the third embodiment.

The following is a description, made with reference to FIG. 9, of a sub-tank 48 according to a third embodiment of the present invention. In this sub-tank 48, a contact protrusion 105, made of stainless steel or a plastic material, stands upright in the bottom surface of the sub-tank body 81 as a float-regulating member. The contact protrusion 105 is configured from a plurality of individual contact protrusions 106, and is formed so that the top ends thereof are positioned above the bottom connecting hole 86 of the liquid column pipe 83. More specifically, the contact protrusion 105 is formed so as to be capable of regulating the descending end position of the bottom surface of the lid float 82 at a position lower than the lower limit detection sensor 93 and higher than the bottom connecting hole 86. Furthermore, the contact protrusion 105 is preferably formed so as to reach from the sub-tank body 81 to the same height as the top end of the bottom connecting hole 86 of the liquid column pipe 83. In this case as well, the capacity of the sub-tank body 81, which is underneath the bottom surface of the lid float 82, whose position is regulated by the contact protrusion 105, is designed so as not to affect the timer control when the functional liquid is being removed.

Figure 10:
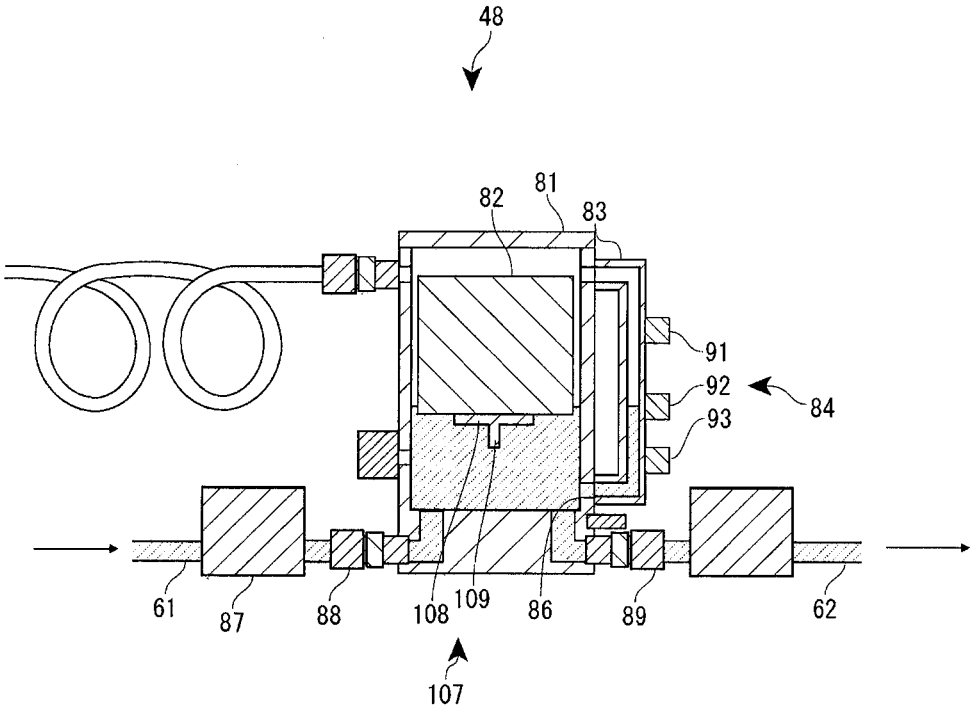
FIG. 10 is a cross-sectional view schematically depicting the surroundings of a sub-tank according to the fourth embodiment.

The following is a description, made with reference to FIG. 10, of a sub-tank 48 according to a fourth embodiment of the present invention. In this sub-tank 48, a hanging protrusion (float-regulating member) 107, made of stainless steel or a plastic material, is suspended as a float-regulating member from the bottom surface of the lid float 82. The hanging protrusion 107 is configured from an attachment plate 108 attached to the bottom surface of the lid float 82, and a regulating protrusion 109 formed protruding in the middle of the attachment plate 108. The regulating protrusion 109 is formed in a rod shape or plate shape, and is provided so as to protrude downward in the middle of the attachment plate 108. The hanging protrusion 107 is also formed so as to have a height reaching from the bottom surface of the sub-tank body 81 to a point above the bottom connecting hole 86 of the liquid column pipe 83. More specifically, the hanging protrusion 107 is formed so as to be capable of regulating the descending end position of the bottom surface of the lid float 82 at a position lower than the lower limit detection sensor 93 and higher than the bottom connecting hole 86. Furthermore, the hanging protrusion 107 is preferably formed so as to reach from the sub-tank body 81 to the same height as the top end of the bottom connecting hole 86 of the liquid column pipe 83. In this case as well, the capacity of the sub-tank body 81, which is underneath the bottom surface of the lid float 82, whose position is regulated by the hanging protrusion 107, is designed so as not to affect the timer control when the functional liquid is being removed.

According to the configuration described above, during functional liquid removal, the descending of the lid float 82 is regulated at a position lower than the lower limit detection sensor 93 and higher than the bottom connecting hole 86, and the amount of functional liquid below the lid float 82 is reliably provided to a certain extent. Therefore, even in cases in which liquid is removed by timer control, a small amount of functional liquid remains in the sub-tank 48, and it is possible to remove this liquid in one removal. The functional liquid remaining in the liquid column pipe 83 and in the small gap between the sub-tank body 81 and the lid float 82 can readily be removed by regulating the position of the lid float 82. Therefore, old functional liquid can be efficiently and in a short amount of time replenished with fresh functional liquid in the functional liquid supply devices 15.

In the present embodiment, functional liquid is replenished using one sub-tank 48 as a replenishing unit, but functional liquid may also be replenished using two sub-tanks 48 as replenishing units. The form of the float-regulating member is not limited to those of the embodiments described above; the float-regulating member need only be capable of regulating the position of the lid float 82 to a predetermined position. For example, the float-regulating member may be in the form of a cord by which the lid float 82 is suspended from the top surface of the sub-tank 48.

The fresh functional liquid may be a detergent for washing all flow channels extending from the main tanks 50 to the functional liquid droplet discharge heads 14. In this case, if the detergent is a solvent of the functional liquid, the number of repetitions described above can be markedly reduced.

GENERAL INTERPRETATION OF TERMS

In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts. Finally, terms of degree such as "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing descriptions of the embodiments according to the present invention are provided for illustration only, and not for the purpose of limiting the invention as defined by the appended claims and their equivalents.

What is claimed is:

1. A droplet discharge device comprising:

a functional liquid droplet discharge head configured and arranged to discharge functional liquid; and a functional liquid tank including a tank body configured and arranged to retain the functional liquid to be supplied to the functional liquid droplet discharge head, the tank body having a first connecting hole and a second connecting hole, a liquid column pipe communicating with the tank body through the first connecting hole and the second connecting hole of the tank body, a liquid level detection mechanism configured and arranged to detect a liquid level of the functional liquid retained in the liquid column pipe, a float member accommodated within the tank body, and a float-regulating member having a facing portion that faces a descending end position of the float member, the facing portion of the float-regulating member being located in the tank body in a position between the first connecting hole and the second connecting hole such that the facing portion regulates the descending end position of the float member when the float member descends as a liquid level within the tank body descends, the functional liquid tank being configured and arranged to allow supplying and ventilating of gas.

2. The droplet discharge device according to claim 1, further comprising a main tank configured and arranged to retain the functional liquid to be supplied to the functional liquid tank, the functional liquid tank and the main tank are connected via an opening/closing valve.

3. The droplet discharge device according to claim 1, wherein the liquid level detection mechanism includes an upper limit liquid level detection unit configured and arranged to detect an upper limit liquid level of the functional liquid, and a lower limit liquid level detection unit configured and arranged to detect a lower limit liquid level of the functional liquid.

4. The droplet discharge device according to claim 2, wherein the liquid level detection mechanism includes an upper limit liquid level detection unit configured and arranged to detect an upper limit liquid level of the functional liquid, and a lower limit liquid level detection unit configured and arranged to detect a lower limit liquid level of the functional liquid.

5. A droplet discharge device comprising:

a functional liquid droplet discharge head configured and arranged to discharge functional liquid; and a functional liquid tank configured and arranged to allow supplying and ventilating of gas, the functional liquid tank including a tank body configured and arranged to retain the functional liquid to be supplied to the functional liquid droplet discharge head, a liquid column pipe communicating with the tank body, a liquid level detection mechanism configured and arranged to detect a liquid level of the functional liquid retained in the liquid column pipe, the liquid level detection mechanism including an upper limit liquid level detection unit configured and arranged to detect an upper limit liquid level of the functional liquid and a lower limit liquid level detection unit configured and arranged to detect a lower limit liquid level of the functional liquid, a float member accommodated within the tank body, and a float-regulating member configured and arranged to regulate a descending end position of the float member when the float member descends as a liquid level within the tank body descends, the float-regulating member being configured and arranged to keep the float member in a position between the lower limit liquid level detection unit and a bottom connecting hole of the liquid column pipe.

6. A droplet discharge device comprising:

a functional liquid droplet discharge head configured and arranged to discharge functional liquid;

a functional liquid tank configured and arranged to allow supplying and ventilating of gas, the functional liquid tank including a tank body configured and arranged to retain the functional liquid to be supplied to the functional liquid droplet discharge head, a liquid column pipe communicating with the tank body, a liquid level detection mechanism configured and arranged to detect a liquid level of the functional liquid retained in the liquid column pipe, the liquid level detection mechanism having an upper limit liquid level detection unit configured and arranged to detect an upper limit liquid level of the functional liquid, and a lower limit liquid level detection unit configured and arranged to detect a lower limit liquid level of the functional liquid, a float member accommodated within the tank body, and a float-regulating member configured and arranged to regulate a descending end position of the float member when the float member descends as a liquid level within the tank body descends; and a main tank configured and arranged to retain the functional liquid to be supplied to the functional liquid tank, the functional liquid tank and the main tank being connected via an opening/closing valve, the float-regulating member being configured and arranged to keep the float member in a position between the lower limit liquid level detection unit and a bottom connecting hole of the liquid column pipe.

* * * * *